US006550284B2

(12) United States Patent
Okamoto

(10) Patent No.: US 6,550,284 B2
(45) Date of Patent: Apr. 22, 2003

(54) KNITTED FABRIC HAVING FORKED PORTION AND KNITTING METHOD THEREOF

(75) Inventor: Kazuyoshi Okamoto, Gose (JP)

(73) Assignee: Shima Seiki Mfg. Ltd., Wakayama (JP)

( * ) Notice: Subject to any disclaimer, the term of this patent is extended or adjusted under 35 U.S.C. 154(b) by 0 days.

(21) Appl. No.: 10/148,181

(22) PCT Filed: Dec. 25, 2000

(86) PCT No.: PCT/JP00/09245

§ 371 (c)(1),
(2), (4) Date: Jun. 5, 2002

(87) PCT Pub. No.: WO01/51692

PCT Pub. Date: Jul. 19, 2001

(65) Prior Publication Data

US 2002/0170322 A1 Nov. 21, 2002

(30) Foreign Application Priority Data

Dec. 27, 1999 (JP) ..... 11-371735

(51) Int. Cl.[7] ..... D04B 7/30
(52) U.S. Cl. ..... 66/69; 66/70; 66/176
(58) Field of Search ..... 66/60 R, 64, 69, 66/68, 70, 71, 169 R, 170, 171, 172 R, 175, 176, 75.1

(56) References Cited

U.S. PATENT DOCUMENTS 5,417,088 A 5/1995 Shima
5,456,096 A * 10/1995 Mitsumoto et al. ..... 66/69
5,584,197 A * 12/1996 Okuno ..... 66/64
5,669,244 A * 9/1997 Okuno ..... 66/64
5,956,975 A * 9/1999 Kawashima ..... 66/64
6,070,438 A * 6/2000 Okuno et al. ..... 66/172 R
6,138,482 A * 10/2000 Shima et al. ..... 66/69

FOREIGN PATENT DOCUMENTS

FR 2176447 * 10/1973 ..... 66/64
JP 9-209248 8/1997
JP 10-53942 2/1998

* cited by examiner

*Primary Examiner*—Danny Worrell
(74) *Attorney, Agent, or Firm*—Rothwell, Figg, Ernst & Manbeck, P.C.

(57) ABSTRACT

Knitting of a knitted fabric having a forked portion which is forked into a first knitting region and a second knitting region at a certain point of its knitting width by using a flat knitting machine including at least two yarn feeders arranged over needle beds. Prior to the knitted fabric being forked, a pair of right and left widening stitch loops that confront each other across the forked portion are formed at the back side of the knitted fabric during a course knitting of the knitted fabric, first, and, then, two groups of stitch loops, consisting of a pair of right and left stitch loops that are formed at a front side of the knitted fabric and confront each other across the forked portion and a pair of right and left widening stitch loops that are newly formed, are crossed to each other across a boundary of the forked portion. This can provide enhanced strength for the forked portion without impairing the appearance of the knitted fabric.

5 Claims, 8 Drawing Sheets

KNITTED FABRIC HAVING FORKED PORTION AND KNITTING METHOD THEREOF

TECHNICAL FIELD

The present invention relates to a knitted fabric that is forked right and left at a certain point of the knitting width and to a knitting method thereof. Particularly, the present invention relates to a knitted fabric having a forked portion having enhanced strength and to a knitting method thereof.

BACKGROUND ART

The knitted fabrics forked right and left at a certain point of the knitting width include a V-neck vest and a V-neck sweater. When wearing the knitwear having the forked portion whose knitted fabric is forked right and left at a certain point of the knitting width, first and second knitted regions into which the knitted fabric is parted right and left at the forked portion are pulled transversely and the transverse tensile force is exerted on the forked portion. When a large tensile force in excess of the yarn's stretch is exerted on the yarn in the forked portion, the yarn is cut off.

For example, when a front body of a V-neck vest is knitted, the front body is knitted in full width until the course at the forked portion of the vest by using one yarn feeder, first. Then, it is knitted so that it can be forked into the right shoulder portion and the left shoulder portion from the forked portion to form a neck portion.

The right shoulder portion is knitted by using the same yarn feeder as one that has been used so far for the full width knitting, while on the other hand, the left shoulder portion is knitted by using another yarn feeder in lieu of the yarn feeder that has been used so far.

Reference is given to three typical knitting methods for forming the forked portion in the process of knitting the front body of the V-neck sweater.

The first one is the knitting method wherein the front body is knitted to be simply forked into the right shoulder portion 104 and the left shoulder portion 102 from the forked portion 101, as shown in the loop diagram of the knitted fabric 100 shown in FIG. 8.

The second one is the knitting method wherein a pair of right and left stitch loops 112, 110 on the front side of a knitted fabric 106, which confront each other across a forked portion 108, are crossed to each other across the boundary X of the forked portion 108, as shown in the loop diagram of the knitted fabric 106 shown in FIG. 9.

The third one is the knitting method wherein two stitch loops 122 and 124, and 126 and 128 for each of the right and left sides of the knitted fabric 118 are crossed to each other across the boundary X of the forked portion 120, as shown in the loop diagram of the knitted fabric 118 shown in FIG. 10.

Those conventional knitting methods described above have the following disadvantages, however.

First, in the first knitting method, the right shoulder portion 104 and the left shoulder portion 102 are joined at the forked portion 101 by a piece of yarn. This knitting method has the disadvantage that only a piece of the yarn cannot provide a satisfactory tensile strength for the forked portion 101.

Second, in the second knitting method, since the right shoulder portion 116 and the left shoulder portion 114 are joined at the forked portion 108 by a total of four parts of yarn in the pair of right and left stitch loops 110, 112, the traverse tensile force acting on the forked portion 108 is dispersed over those four parts of yarn and, as a result of this, the knitted fabric can have strength four times as more as the knitted fabric whose right and left shoulder portions are joined at the forked portion by a piece of yarn, as the knitted fabric shown in FIG. 8. In addition, since the pair of right and left stitch loops 110, 112 are simply crossed to each other, the stitch loops 110, 112 thus crossed are not separated with respect to the thickness direction, when viewed from the top, and thus the appearance of the knitted fabric is not impaired substantially.

However, depending on the variety including kinds of yarns used, there may still be the cases where unsatisfactory tensile strength may be provided for the forked portion by simply crossing the pair of right and left stitch loops across the boundary of the forked portion.

Finally, in the third knitting method, since the right shoulder portion and the left shoulder portion are joined at the forked portion 120 by a total of eight parts of yarn in the two stitch loops 122, 124, 126, 128 for each of the right side and the left side, the traverse tensile force acting on the forked portion is dispersed over those eight parts of yarn and, as a result of this, the forked portion 120 of the knitted fabric can have enhanced strength. However, in this knitting method, since two stitch loops 122 and 124, and 126 and 128 for each of the right and left sides at the front side of the knitted fabric are crossed, the paired right and left stitch loops 122 and 124, and 126 and 128 thus crossed are separated largely with respect to the thickness direction, when the forked portion is viewed from the top, and thus the appearance of the knitted fabric is impaired.

It is the object of the invention to provide a knitting method that can solve the problems involved in the prior art mentioned above and can provide enhanced strength of a forked portion of a knitted fabric without impairing the appearance. It is another object of the invention to provide a knitted fabric having a forked portion having good appearance and enhanced strength.

DISCLOSURE OF THE INVENTION

To accomplish the objects mentioned above, the present invention provides a method of knitting a knitted fabric which is forked into a first knitting region and a second knitting region at a certain point of its knitting width by using a flat knitting machine comprising at least a pair of front and back needle beds, which are placed with their front ends confronting each other and at least either of which is racked laterally with respect to the other needle bed, and at least two yarn feeders arranged over the at least the pair of needle beds, the knitting method comprising:

1) the step that prior to the knitted fabric being forked, a pair of right and left widening stitch loops that confront each other across the forked portion are formed at the back side of the knitted fabric during a course knitting of the knitted fabric; and
2) the step that two groups of stitch loops, consisting of a pair of right and left stitch loops that are formed at a front side of the knitted fabric and confront each other across the forked portion and the pair of right and left widening stitch loops formed in the step 1, are crossed to each other across a boundary of the forked portion.

Preferably, the step of crossing the two groups of stitch loops to each other is taken in the order in which the pair of right and left stitch loops that are formed at the front side of the knitted fabric and confront each other across the forked portion are crossed to each other by transference, so as to change in position, first, and, then, the widening stitch loops formed in the step 1 are crossed to each other and laid over the stitch loops on the front side as were transferred across the boundary of the forked portion, respectively.

Also, the present invention provides a knitted fabric having a forked portion, which is knitted by using a flat knitting machine and is forked right and left into a first knitting region and a second knitting region at a certain point of its knitting width, and wherein a pair of right and left widening stitch loops that confront each other across the forked portion and are formed at the back side of the knitted fabric and a pair of right and left stitch loops that confront each other across the forked portion and are formed at a front side of the knitted fabric are crossed to each other across the forked portion and are overlaid with each other, respectively.

Further, the present invention provides a method of knitting a knitted fabric having a forked portion which is forked into a first knitting region and a second knitting region at a certain point of its knitting width by using a flat knitting machine comprising at least a pair of front and back needle beds, which are placed with their front ends confronting each other and at least either of which is racked laterally with respect to the other needle bed, and at least two yarn feeders arranged over the at least the pair of needle beds, wherein the forked portion comprises at least one forked side end loop located in a center of the forked portion and crossing loop groups located at both sides of the at least one forked side end loop and confronting each other across the at least one forked side end loop and wherein the at least one forked side end loop and a loop of one of the crossing loop groups are overlaid with each other in such a manner that the other crossing loop group can be sandwiched between the least one forked side end loop and the one crossing loop group, the knitting method comprising:

1) the step that the crossing loop groups are each moved across a boundary of the forked portion and are overlaid with each other; and
2) the step that the at least one forked side end loop and any loop of the one crossing loop group are overlaid with each other.

Also, the present invention provides a knitted fabric having a forked portion, which is knitted by using a flat knitting machine and is forked right and left into a first knitting region and a second knitting region at a certain point of its knitting width, and wherein the forked portion comprises at least one forked side end loop located in a center of the forked portion and crossing loop groups located at both sides of the at least one forked side end loop and confronting each other across the at least one forked side end loop, and wherein the at least one forked side end loop and a loop of one of the crossing loop groups are overlaid with each other in such a manner that the other crossing loop group can be sandwiched between the least one forked side end loop and the one crossing loop group.

BEST MODE FOR CARRYING OUT THE INVENTION

Certain preferred embodiments of the present invention will be described below with reference to the accompanying drawings. The present invention is practicable with a flat knitting machine comprising at least a pair of front and back needle beds, which are placed with their front ends confronting each other and at least either of which can be racked transversely relative to the other needle bed, and a plurality of yarn feeders arranged over the needle beds. In the illustrated embodiments, a two-needle-bed flat knitting machine having a pair of front and back needle beds in which the back needle bed can be racked relative to the front needle bed is used. It is to be noted that a fewer number of needles than the actual number of needles is illustrated for explanation of the embodiments.

Figure 1:
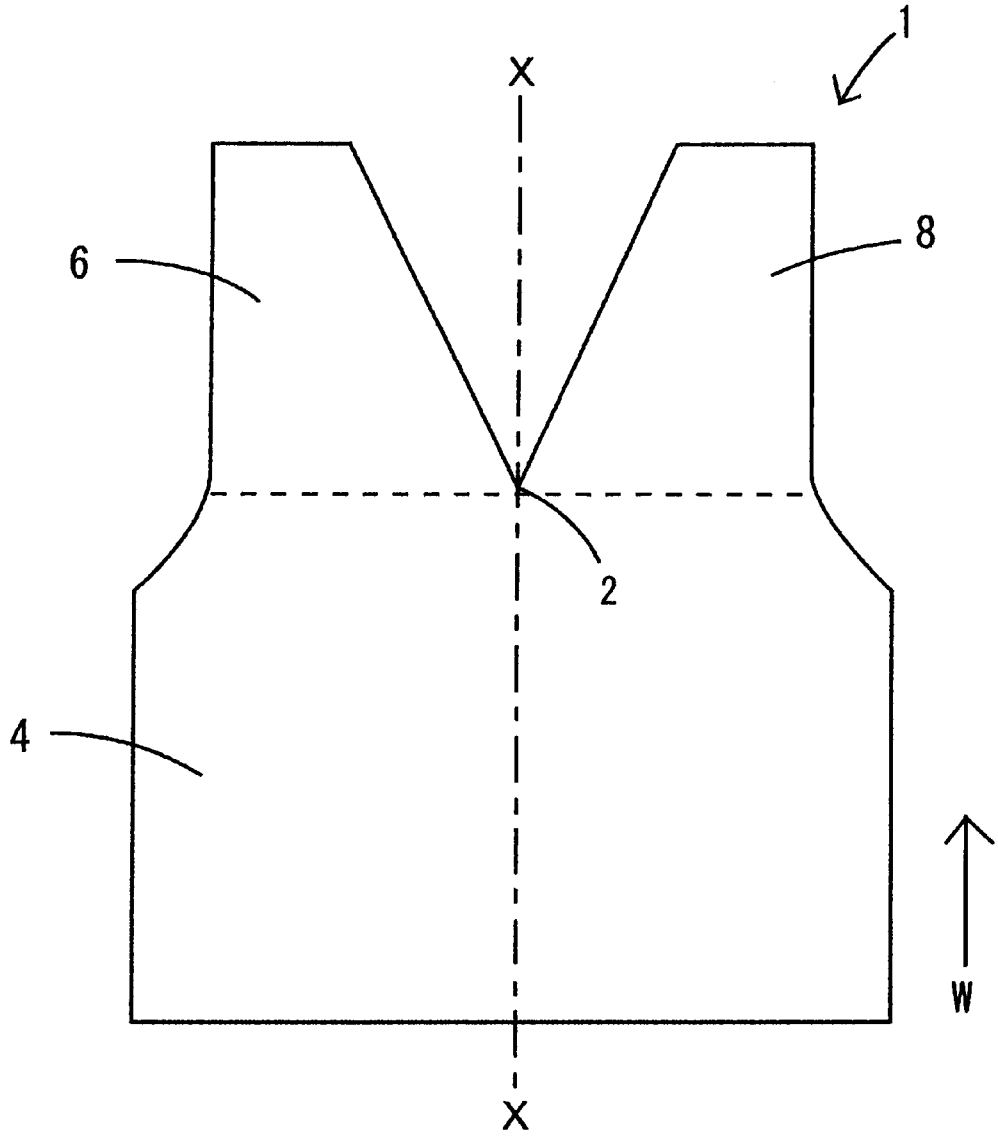
FIG. 1 shows a front body of a vest knitted in a knitting method of the invention.

Referring to FIG. 1, there is shown a front body of a V-neck vest knitted in the first embodiment. The front body 1 of the vest knitted in this embodiment is knitted in plain knitting. The front body 1 comprises a full width portion 4 that is knitted in full width to the direction indicated by an arrow W until a forked portion 2, a right shoulder portion 6 of a first knitting region and a left shoulder portion 8 of a second knitting region that are knitted so that they can be parted right and left from the forked portion 2, as shown in FIG. 1.

The full width portion 4 and the right shoulder portion 6 are knitted by using a yarn feeder 10 and the left shoulder portion 8 is knitted by using another yarn feeder 12. A broken line X—X indicates a boundary of the forked portion 2. In the following, the knitting of the forked portion 2 is described as the first to fourth embodiments.

First Embodiment

Figure 2:
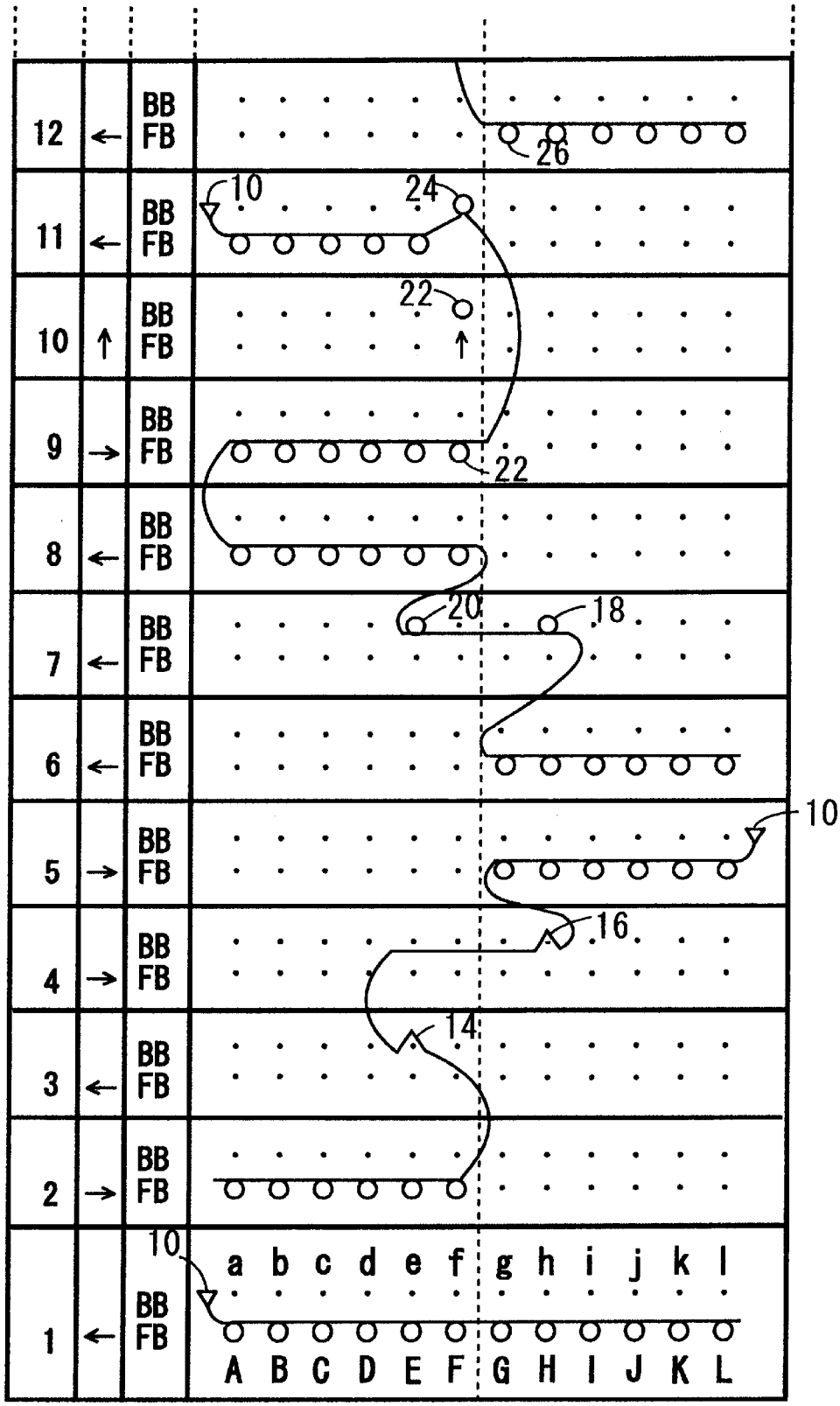
FIG. 2 shows a knitting course diagram of the first embodiment of the invention.
Figure 3:
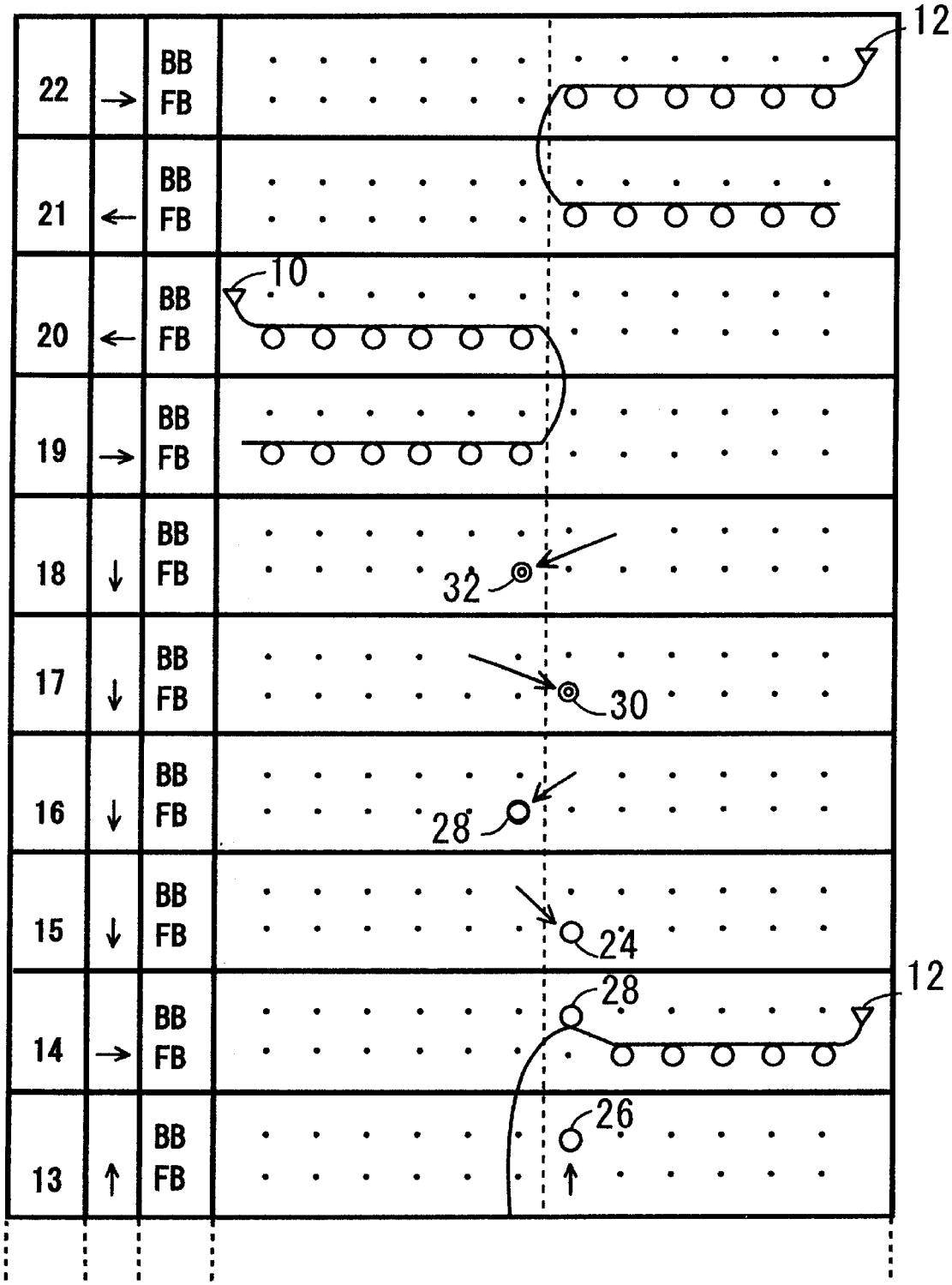
FIG. 3 shows a knitting course diagram of the first embodiment of the invention.

In FIGS. 2 and 3, the numerals at the left side indicate the serial number of the courses; the horizontal arrows at the right side of the number of the courses indicate the direction for the yarn feeder 10, 12 to be racked; the vertical arrows indicate the direction for the loops to be transferred; and FB and BB at the right side of the vertical arrows indicate a front bed and a back bed, respectively. Alphabetical letters arranged vertically of the course 1 represent reference numbers of knitting needles. Capital letters "A" to "L" represent knitting needles of the front bed FB and lowercase letters "a" to "l" represent knitting needles of the back bed BB.

The knitting course 1 of FIG. 2 represents the knitting of the full width portion 4 of the front body 1. In the course 1, the yarn feeder 10 is shifted leftward by a carriage (not shown) to feed a yarn to the needles L-A of the front bed FB, so as to form loops thereat.

In the course 2, the yarn feeder 10 is shifted rightward to feed the yarn to the needles A-F of the front bed FB, so as to form loops thereat. Then, the yarn feeder 10 is shifted back to the left side of the needle "e" of the back bed BB. In the course 3, the yarn is fed to the needle "e" of the back bed BB on which no loop is held, for tucking 14. Thereafter, in the course 4, the yarn feeder 10 is shifted rightward to feed the yarn to the needle "h" of the back bed BB, for tucking 16. Subsequently, the yarn feeder 10 is shifted back to the left side of the needle "G" of the front bed FB. In the course 5, the yarn feeder 10 is shifted rightward to feed the yarn to the needles G-L of the front bed FB, so as to form the loops thereat.

Then, in the course 6, the yarn feeder 10 is shifted leftward to feed the yarn to the needles L-G of the front bed FB, so as to form loops thereat. Then, the yarn feeder 10 is shifted back to the right side of the needle "h" of the back bed BB. Then, in the course 7, the yarn is fed to the needles "h", "e" of the back bed BB to form loops 18, 20 thereat. The loops 18, 20 thus formed on the needles "h", "e" of the back bed BB, which comes to be the loops at the back side of the knitted fabric 1, are held thereon in the form of widening stitch loops.

Then, the yarn feeder 10 is shifted to the right side of the needle F of the front bed FB. In the course 8, the yarn feeder 10 is shifted leftward to feed the yarn to the needles F-A of the front bed FB, so as to form loops thereat. Then, in the course 9, the yarn feeder 10 is reversed and shifted rightward to feed the yarn to the needles A-F of the front bed FB, so as to form loops thereat.

In the course 10, the loop 22 held on the needle "F" of the front bed FB is transferred to the needle "f" of the back bed. Then, the yarn feeder 10 is reversed in direction. In the course 11, the yarn is fed to the needle "f" of the back bed BB to form a loop 24 thereat and is also fed to the needles E-A of the front bed FB to form loops thereat.

Then, in the course 12, the yarn feeder 12 is shifted leftward to feed the yarn to the needles L-G of the front bed FB, so as to form loops thereat. In the course 13, the loop 26 held on the needle G of the front bed FB is transferred to the needle "g" of the back needle bed BB. Then, the yarn feeder 12 is reversed in direction. In the course 14, the yarn is fed to the needle "g" of the back bed BB to form a loop 28 thereat and is also fed to the needles H-L of the front bed FB to form loops thereat.

In the course 15, the loop 24 held on the needle "f" of the back bed BB is transferred to the needle "G" of the front bed FB. In the course 16, the loop 28 held on the needle "g" of the back bed BB is transferred to the needle "F" of the front bed FB. With this knitting, the crossing of the pair of right and left loops 24, 28 on the front side of the knitted fabric across the boundary of the forked portion is completed.

Then, in the course 17, the loop 20 held on the needle "e" of the back bed BB is transferred to the needle "G" of the front bed FB and is laid over the loop 24 held on the needle "G" to form a double loop 30 thereat. In the course 18, the loop 18 held on the needle "h" of the back bed BB is transferred to the needle "F" of the front bed FB and is laid over the loop 28 held on the needle "F" to form a double loop 32 thereat. With this knitting, the crossing of the pair of right and left widening stitch loops 18, 20 which are formed at the back side of the knitted fabric 1 and confront each other across the forked portion 2 is completed.

Then, in the course 19, the yarn feeder 10 is shifted rightwards to feed the yarn to the needles A-F of the front bed FB, so as to form loops thereat. Thereafter, in the course 20, the yarn feeder 10 is reversed in direction to feed the yarn to the needles F-A of the front bed FB, so as to knit the right shoulder portion 6.

In the course 21, the yarn feeder 12 is shifted leftward to feed a yarn to the needles L-G of the front bed FB, so as to form the loops thereat. In the course 22, the yarn feeder 12 is reversed in direction to feed the yarn to the needles G-L of the front bed FB, so as to knit the left shoulder portion 8.

Subsequently, the knitting of the right shoulder portion 6 and the left shoulder portion 8 is continued.

Figure 4:
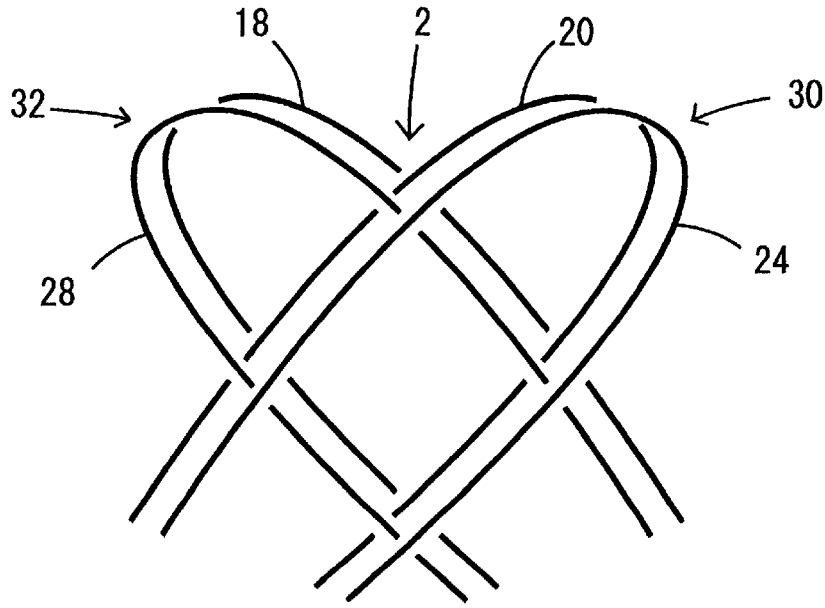
FIG. 4 shows a loop diagram of a forked portion of a knitted fabric knitted in the first embodiment of the invention.

As seen from FIG. 4, the pair of right and left loops 24, 28, which are formed at the front side of the knitted fabric 1 and confront each other across the forked portion 2, are crossed to each other, first. Then, the pair of right and left loops 18, 20, which were formed at the back side of the knitted fabric 1 and confront each other across the forked portion 2, are crossed to each other and are laid over the loops 24, 28 at the front side of the knitted fabric as were transferred across the boundary of the forked portion 2, respectively, to form double loops 30, 32. As a result of this, the right shoulder portion 6 of the first knitting region and the left shoulder portion 8 of the second knitting region are joined at the forked portion 2 of the knitted fabric 1 by eight parts of yarns in the loops, thus providing enhanced strength for the forked portion 2.

Also, since the four loops 24, 28, 20, 18 to form the forked portion 2 of the knitted fabric 1 knitted in the first embodiment are alternately transferred from side to side, undesirable separation of the folded portion 2 of the knitted fabric 1 with respect to the thickness direction is avoided and thus impairment of the appearance of the knitted fabric 1 resulting therefrom is avoided.

It should be noted that when the knitted fabric 1 is knitted in the knitting method of the first embodiment, the loops forming the forked portion 2 may be slacked and thereby holes may be formed in the knitted fabric 1, due to a number of loops being formed at the needles F, G of the front bed FB before the pair of right and left loops 24, 28 to be crossed across the boundary of the forked portion are formed at the front side of the knitted fabric 1. In this case, the loops at the needle F of the front bed FB in the course 2, the needle G of the front bed FB in the course 5, the needle G of the front bed FB in the course 6, the needle F of the front bed FB in the course 8, the needle F of the front bed FB in the course 9, and the needle G of the front bed FB in the course 12 can be missed.

Second Embodiment

Figure 5:
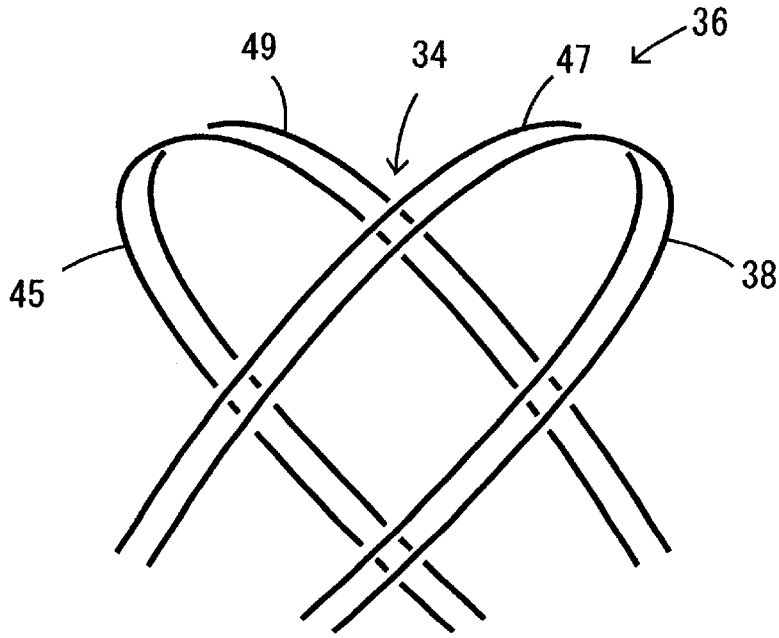
FIG. 5 shows a loop diagram of a forked portion of a knitted fabric knitted in the second embodiment of the invention.

Reference is now given to the second embodiment of the present invention. In the first embodiment, after the pair of right and left loops which are formed at the front side of the knitted fabric and confront each other across the forked portion are transferred to be crossed to each other, so as to be changed in position, the pair of right and left widening stitch loops confronting each other across the forked portion, that were previously formed at the back side of the knitted fabric before forking the knitted fabric, are crossed to each other and laid over their respective loops at the front side that were transferred across the boundary of the forked portion. In contrast to this, in the second embodiment, the pair of right and left loops which are formed at the front side of the knitted fabric and confront each other across the forked portion and the pair of right and left widening stitch loops which prior to forking the knitted fabric, were formed at the back side of the knitted fabric and confront each other across the forked portion during the course knitting of the knitted fabric are laid over each other to form double loops and then are crosses to each other across the boundary of the forked portion in this state of things. The loop diagram of the forked portion of the knitted fabric knitted in the second embodiment is shown in FIG. 5.

In the second embodiment, two groups of loops, consisting of the pair of right and left loops 38, 40 formed at the front side of the knitted fabric 36 and confronting each other across the forked portion 34 and the pair of right and left widening stitch loops 42, 44 formed at the back side of the knitted fabric 36 and confronting each other across the forked portion 34, are crossed to each other across the boundary of the forked portion 34. As a result of this, the right and left shoulder portions of the knitted fabric 36 are joined at the forked portion by a total of eight parts of yarns in the loops, thus providing strength substantially equal to that of the first embodiment for the forked portion 34.

Although the forked portion 34 of the knitted fabric 36 knitted in the second embodiment may be separated to some extent with respect to the thickness direction, as compared with the forked portion 2 of the knitted fabric 1 of the first embodiment, such separation is not so much as to impair the appearance of the knitted fabric 36.

While the embodiment illustrated above follows the order that after the pair of right and left loops formed at the front side of the knitted fabric and confronting each other across the forked portion are transferred and thus crossed to each other, so as to be changed in position, the pair of widening stitch loops are crossed to each other and are laid over the loops at the front side as were transferred across the boundary of the forked portion, respectively, the order in which the loops are laid over the related loops may be reversed. Alternatively, another pair of loops may be laid over the other loops, rather than over the pair of crossed loops.

While the embodiment illustrated above takes the step that after the yarn is tucked on the needle on which no loop at the back side of the knitted fabric is held, the widening stitch loops are formed, it may take another step that the loops are formed by split knitting and the loops thus formed are used as the widening stitch loops.

Figure 10:
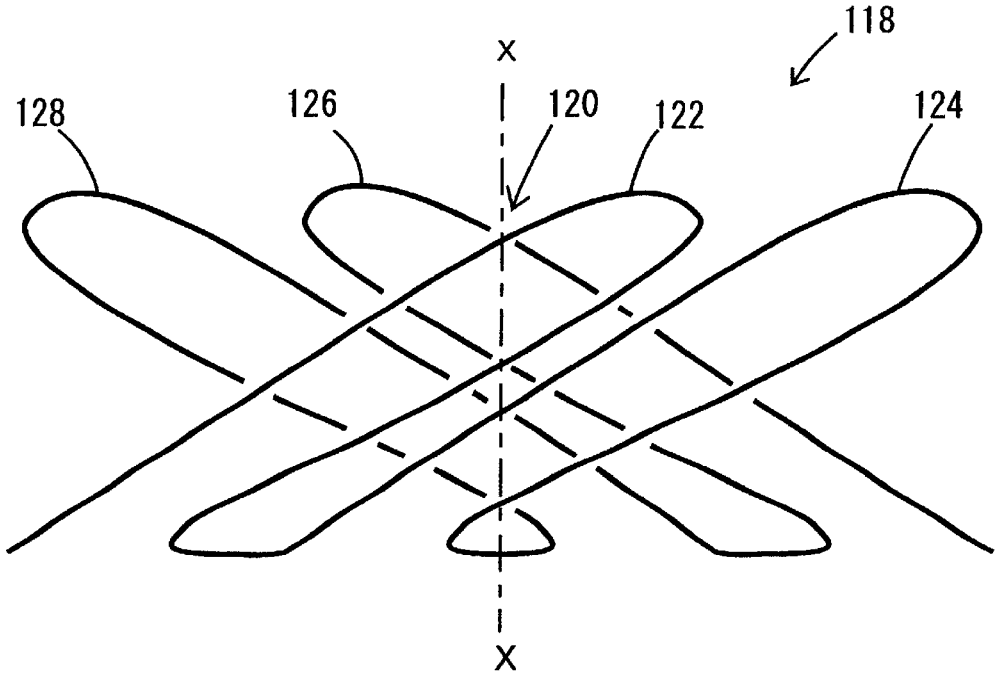
FIG. 10 shows a loop diagram of a forked portion of a fabric knitted in still another conventional knitting method.

While in the embodiment illustrated above, two stitch loops are crossed to each other for each of the pair of right and left widening stitch loops and for each of the pair of right and left stitch loops at the front side of the knitted fabric, the right and left loops in pairs are not limited to two stitch loops. For example, the present invention may take the step that after the two right and left stitch loops at the front side of the knitted fabric are crossed to each other, as in the knitted fabric 118 of FIG. 10 illustrating the prior art, the widening stitch loops are crossed to each other and laid over the crossed stitch loops 122, 126.

Third Embodiment

Figure 6:
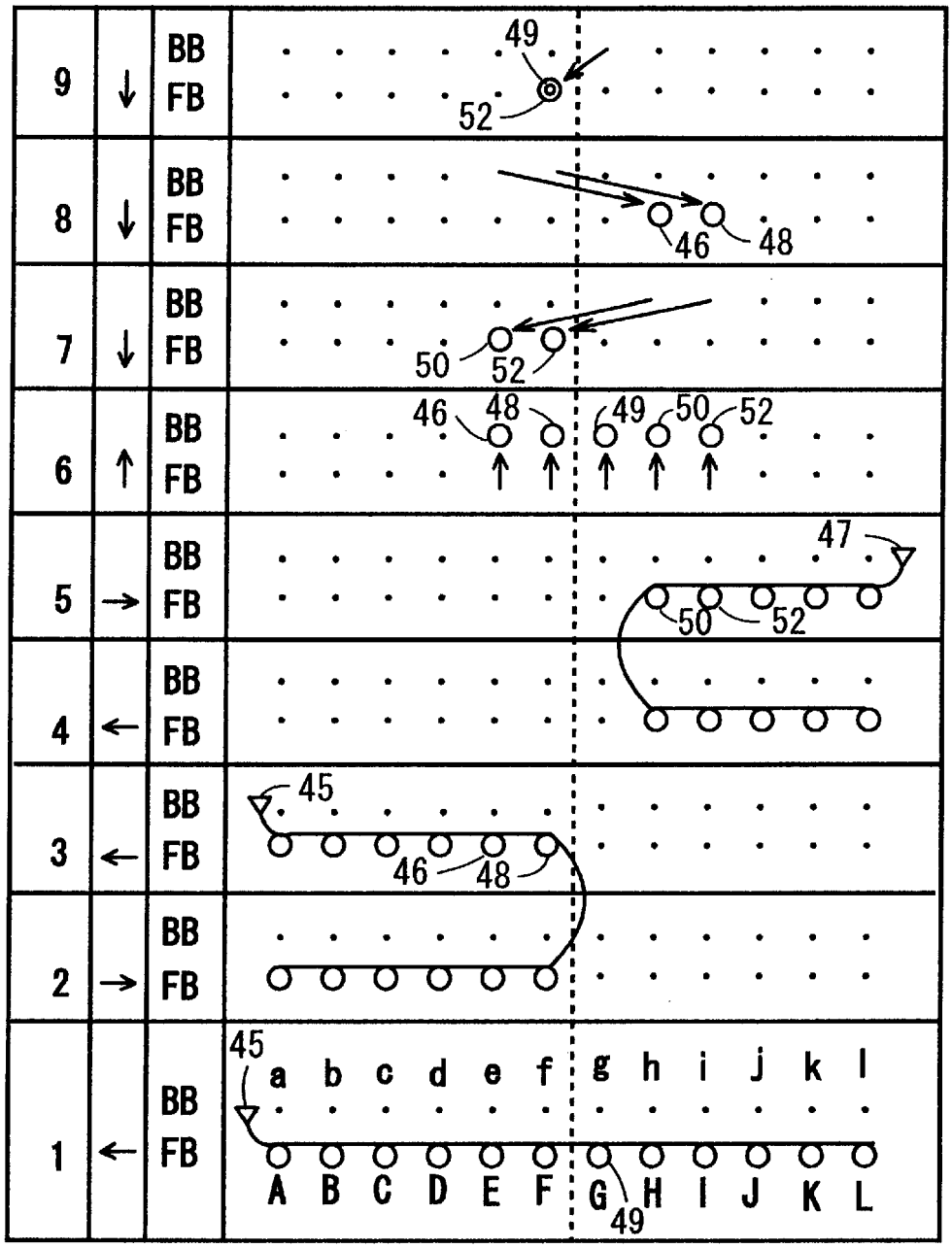
FIG. 6 shows a knitting course diagram of the third embodiment of the invention.

Referring now to FIG. 6, the third embodiment will be described. In the course 1 of the third embodiment, a yarn feeder 45 is shifted leftward to feed a yarn to the needles L-A of the front bed FB, so as to knit the full width portion 4. In the course 2, the yarn feeder 45 is shifted rightward to feed the yarn to the needles A-F of the front bed FB, so as to form loops thereat. In the course 3, the yarn feeder 45 is reversed in direction to feed the yarn to the needles F-A of the front bed FB, so as to form loops thereat. Then, in the course 4, an additional yarn feeder 47 is used for the knitting and a yarn is fed to the needles L-H of the front bed FB by the yarn feeder 47 to form loops thereat. In the course 5, the yarn feeder 47 is reversed in direction to feed the yarn to the needles H-L of the front bed FB, so as to form loops thereat. It is to be noted that the knitting of the courses 2–5 is the relief knitting for preventing the forked portion from being stretched out when groups of crossing loops are crossed to each other in the sequential knitting step and accordingly is not of the essential knitting.

The forked portion is started to be formed in the subsequent knitting steps. In the third embodiment, when the loop located in the center of the forked portion (which is hereinafter referred to as "the forked side end loop") and any loops of the groups of loops which are located on both sides of the forked side end loop and confront each other across the forked side end loop (which are hereinafter referred to as "the crossing loop group") are overlaid with each other, the loops of the two crossing loop groups are moved to the opposite side across the boundary of the forked portion, respectively, to cross the crossing loop groups to each other and also the forked side end loop and one of the crossing loop groups are overlaid with each other in such a manner as to sandwich the other of the crossing loop groups between the forked side end loop and the one crossing loop group, whereby the forked portion is formed.

In the third embodiment, the loop 49 held on the needle "G" adjacent to the forked portion is represented as the forked side end loop, and the loops 46, 48 held on the needles E, F and the loops 50, 52 held on the needles H, I are represented as the crossing loop groups.

In the course 6, the forked side end loop 49 held on the needle G of the front bed FB, the loops 46, 48 of the crossing loop groups held on the needles E, F and the loops 50, 52 of the crossing loop groups held on the needles H, I located on the both sides of the forked side end loop 49 are transferred to the needles e-i of the back needle bed BB, for preparation of the crossing of the crossing loop groups to each other. Then, in the course 7, the loops 50, 52 of the crossing loop group held on the needles h, i of the back bed BB are transferred to the needles E, F of the front bed FB. In the course 8, the loops 46, 48 of the crossing loop group held on the needles e, f of the back bed BB are transferred to the needles H, I of the front bed FB so that they can be crossed to the loops of the crossing loop group as transferred in the course 7. Sequentially, in the course 9, the forked side end loop 49 at the needle "g" of the front bed FB is transferred to the needle F of the front bed FB and is laid over the loop 52 of the crossing loop group. The knitting of the forked portion is completed by following the knitting steps mentioned above. In the sequent knitting steps, loops of the next course are sequentially formed on the loops held on the needles A-F and H-L of the front bed FB, to form the first knitting region and the second knitting region.

By following the knitting procedures mentioned above, the loop 52 of the crossing loop group and the forked side end loop 49 are overlaid with each other, whereby they are joined to each other. In this embodiment, since the forked side end loop 49 is laid over the loop 52 of the crossing loop group that was previously transferred to the front bed FB in the course 7, the crossing loop group that was previously transferred to the front bed in the course 8 is sandwiched between the forked side end loop 49 and the loop 52 of the crossing loop group. As a result of this, even when the forked portion is pulled, the crossing loop group is hardly stretched out with respect to the thickness direction, thus providing a good-looking forked portion. It should be noted that according to the embodiment mentioned above, in the course 2–5, the relief knitting using the needle G holding the forked side end loop thereon is not performed. As a result of this, the space between the forked side end loop and the crossing loop group is narrowed, so that it becomes even harder for the crossing loop group to be stretched out with respect to the thickness direction.

Fourth Embodiment

Figure 7:
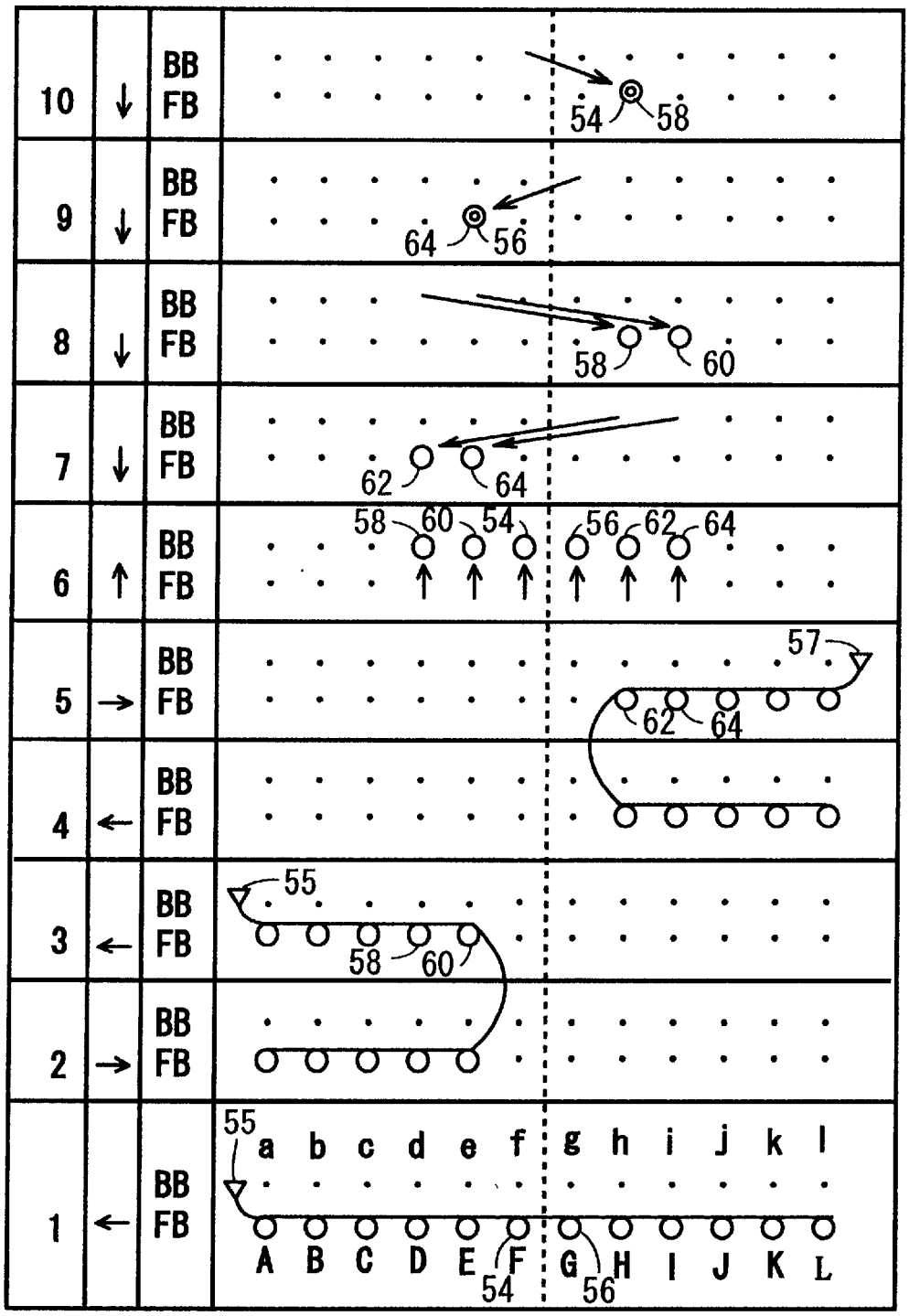
FIG. 7 shows a knitting course diagram of the fourth embodiment of the invention.
Figure 8:
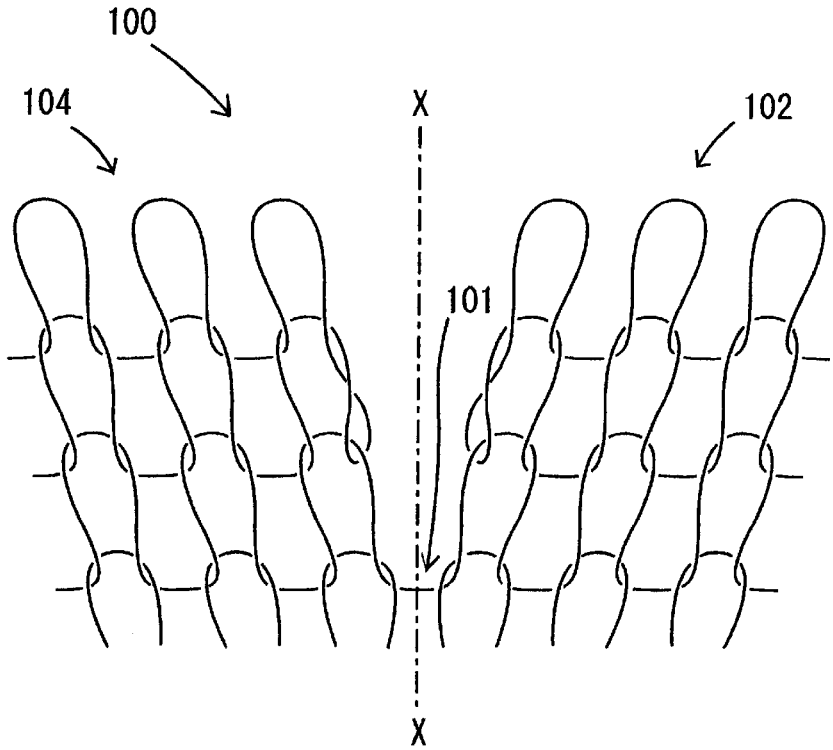
FIG. 8 shows a loop diagram of a fabric knitted in a conventional knitting method.
Figure 9:
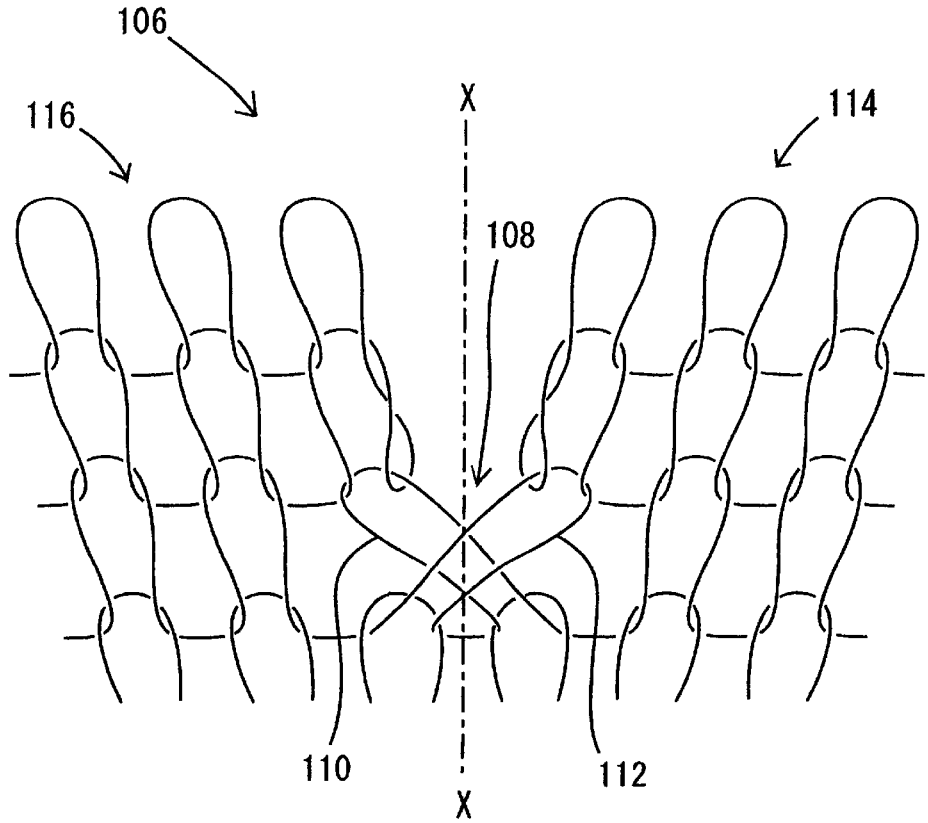
FIG. 9 shows a loop diagram of a fabric knitted in another conventional knitting method.

Referring now to FIG. 7, the fourth embodiment will be described. The fourth embodiment is a variation of the third embodiment. In the course 1 of FIG. 7, a yarn is fed to the needles L-A of the front bed FB by a yarn feeder 55. Then, in the courses 2 and 3, the yarn is fed to the needles A-E by the yarn feeder 55. Sequentially, in the courses 4 and 5, a yarn is fed to the needles H-L of the front bed FB by a yarn feeder 57, for the relief knitting. In the course 6, forked side end loops 54, 56 at the needles F, G located on the both lateral sides of the forked portion, loops 58, 60 of one crossing loop group at the needles D, E and loops 62, 64 of the other crossing loop group at the needles H, I, which are located at the outside of those forked side end loops 54, 56, respectively, are transferred to the associated needles of the back bed BB, respectively.

In the course 7, the loops 62, 64 of the crossing loop group held on the needles h, i of the back bed are transferred to the needles D, E of the front bed across the boundary of the forked portion. In the course 8, the loops 58, 60 of the crossing loop group held on the needles d, e of the back bed are transferred to the needles H, I of the front bed across the boundary of the forked portion to cross the crossing loop groups to each other. Sequentially, in the course 9, the forked side end loop 56 held on the needle g of the back bed BB is transferred to the needle E of the front bed FB and is laid over the loop 64 of the crossing loop group. In the course 10, the forked side end loop 54 held on the needle f of the back bed BB is transferred to the needle H of the front bed FB and is laid over the loop 58 of the crossing loop group. The knitting of the forked portion is completed by following the knitting steps mentioned above. In the sequent knitting steps, loops of the next course are sequentially formed on the loops held on the needles A-E and H-L of the front bed FB, to form the first knitting region and the second knitting region.

By following the knitting procedures mentioned above, the loops 58, 60 of the one crossing loop group are sandwiched between the forked side end loop 56 and the loop 64 of the other crossing loop group that were overlaid with each other by knitting the course 7, 9 and also the forked side end loop 56 is sandwiched between the forked side end loop 54 and the loops 58, 60 of the one crossing loop group that were overlaid with each other by knitting the course 8, 10. As a result of this, even when the forked portion is pulled in the transverse direction, the crossing loop group is hardly stretched out with respect to the thickness direction, thus providing a good-looking forked portion.

While in the embodiments mentioned above, the knitting of the V-neck vest has been described, the present invention is practicable to any knitted fabrics having a forked portion such as a U-neck vest or sweater and to a starting point of the bind-off process. Further, the present invention is also applicable to a neck of a seamless knitted fabric, a starting point of the bind-off process, and a starting point of a side of a vest. While in the embodiments mentioned above, the knitting of the plain V-neck vest has been described, the present invention is equally practicable to a knitted fabric knitted in wide rib.

While preferred embodiments of the invention have been illustrated above, it is to be understood that the present invention is not limited thereto but may practicably be embodied variously within the sprit and scope of the present invention.

Capabilities of Exploitation in Industry

According to the present invention, the knitted fabric having forked portion is formed in such a manner that a pair of right and left widening stitch loops that are formed at the back side of the knitted fabric and confront each other across the forked portion and a pair of right and left stitch loops that are formed at the front side of the knitted fabric and confront each other across the forked portion are crossed to each other across the boundary of the forked portion and are overlaid with each other, respectively. As a result of this, the first knitting region and the second knitting region are joined to each other at the forked portion of the knitted fabric by a total of eight parts of yarns in the two pairs of loops, thus providing enhanced strength for the forked portion of the knitted fabric.

In addition, the widening stitch loops to enhance the strength of the forked portion are formed at the back side of the knitted fabric, so that separation of the stitch loops forming the forked portion with respect to the thickness direction is substantially avoided even when viewed from the top. As a result of this, impairment of the appearance of the knitted fabric can be avoided.

Also, according to the present invention, the one crossing loop group and the other crossing loop group, which are located at the outside of the forked side end loop adjacent to the forked portion to confront each other across the forked side end loop, are moved across the boundary of the forked portion in such a manner that the both crossing loop groups can be crossed to each other and also are overlaid with each other in such a manner that the one crossing loop group can be sandwiched between the loop of the other crossing loop group and the forked side end loop. As a result of this, the loops thus crossed can be prevented from being stretched out with respect to the thickness direction and, accordingly, impairment of the appearance of the knitted fabric can be avoided.

What is claimed is:

1. A method of knitting a knitted fabric which is forked into a first knitting region and a second knitting region at a certain point of its knitting width by using a flat knitting machine comprising at least a pair of front and back needle beds, which are placed with their front ends confronting each other and at least either of which is racked laterally with respect to the other needle bed, and at least two yarn feeders arranged over the at least the pair of needle beds, the knitting method comprising:

1) the step that prior to the knitted fabric being forked, a pair of right and left widening stitch loops that confront each other across the forked portion are formed at the back side of the knitted fabric during a course knitting of the knitted fabric; and 2) the step that two groups of stitch loops, consisting of a pair of right and left stitch loops that are formed at a front side of the knitted fabric and confront each other across the forked portion and the pair of right and left widening stitch loops formed in the step 1, are crossed to each other across a boundary of the forked portion.

2. The method of knitting a knitted fabric having a forked portion according to claim 1, wherein the step of crossing the two groups of stitch loops to each other is taken in the order in which the pair of right and left stitch loops that are formed at the front side of the knitted fabric and confront each other across the forked portion are crossed to each other by transference, so as to change in position, first, and, then, the widening stitch loops formed in the step 1 are crossed to each other and laid over the stitch loops on the front side as were transferred across the boundary of the forked portion, respectively.

3. A knitted fabric having a forked portion, which is knitted by using a flat knitting machine and is forked right and left into a first knitting region and a second knitting region at a certain point of its knitting width, and wherein a pair of right and left widening stitch loops that confront each other across the forked portion and are formed at the back side of the knitted fabric and a pair of right and left stitch loops that confront each other across the forked portion and are formed at a front side of the knitted fabric are crossed to each other across the forked portion and are overlaid with each other, respectively.

4. A method of knitting a knitted fabric having a forked portion which is forked into a first knitting region and a second knitting region at a certain point of its knitting width by using a flat knitting machine comprising at least a pair of front and back needle beds, which are placed with their front ends confronting each other and at least either of which is racked laterally with respect to the other needle bed, and at least two yarn feeders arranged over the at least the pair of needle beds, wherein the forked portion comprises at least one forked side end loop located in a center of the forked portion and crossing loop groups located at both sides of the at least one forked side end loop and confronting each other across the at least one forked side end loop and wherein the at least one forked side end loop and a loop of one of the crossing loop groups are overlaid with each other in such a manner that the other crossing loop group can be sandwiched between the least one forked side end loop and the one crossing loop group, the knitting method comprising:

1) the step that the crossing loop groups are each moved across a boundary of the forked portion and are overlaid with each other; and 2) the step that the at least one forked side end loop and any loop of the one crossing loop group are overlaid with each other.

5. A knitted fabric having a forked portion, which is knitted by using a flat knitting machine and is forked right and left into a first knitting region and a second knitting region at a certain point of its knitting width, and wherein the forked portion comprises at least one forked side end loop located in a center of the forked portion and crossing loop groups located at both sides of the at least one forked side end loop and confronting each other across the at least one forked side end loop, and wherein the at least one forked side end loop and a loop of one of the crossing loop groups are overlaid with each other in such a manner that the other crossing loop group can be sandwiched between the least one forked side end loop and the one crossing loop group.

* * * * *